US009324485B2

(12) United States Patent
Hioki et al.

(10) Patent No.: US 9,324,485 B2
(45) Date of Patent: Apr. 26, 2016

(54) MATERIAL FOR ANISOTROPIC MAGNET AND METHOD OF MANUFACTURING THE SAME

(75) Inventors: Keiko Hioki, Nagoya (JP); Takao Yabumi, Nagoya (JP); Hayato Hashino, Tokai (JP)

(73) Assignee: DAIDO STEEL CO., LTD., Aichi-Ken (JP)

( * ) Notice: Subject to any disclaimer, the term of this patent is extended or adjusted under 35 U.S.C. 154(b) by 0 days.

(21) Appl. No.: 12/683,125

(22) Filed: Jan. 6, 2010

(65) Prior Publication Data

US 2010/0172783 A1 Jul. 8, 2010

Related U.S. Application Data

(63) Continuation-in-part of application No. 12/392,329, filed on Feb. 25, 2009.

(30) Foreign Application Priority Data

| | | |
|---|---|---|
| Feb. 29, 2008 | (JP) | 2008049685 |
| Jan. 7, 2009 | (JP) | 2009002054 |
| Aug. 21, 2009 | (JP) | 2009192178 |

(51) Int. Cl.

| | |
|---|---|
| ***H01F 1/00*** | (2006.01) |
| ***H01F 1/057*** | (2006.01) |
| ***B22F 1/00*** | (2006.01) |

(Continued)

(52) U.S. Cl.

CPC ..... *H01F 1/0576* (2013.01); *B22F 1/0055* (2013.01); *C21D 8/1205* (2013.01); *C21D 8/1261* (2013.01); *C22C 38/002* (2013.01); *C22C 38/005* (2013.01);

(Continued)

(58) Field of Classification Search

USPC ..... 148/302; 419/28

See application file for complete search history.

(56) References Cited

U.S. PATENT DOCUMENTS 4,792,367 A 12/1988 Lee
5,395,462 A * 3/1995 Takeshita et al. ..... 148/302

(Continued)

FOREIGN PATENT DOCUMENTS

| | | |
|---|---|---|
| CN | 1181600 | 5/1998 |
| CN | 1293435 | 5/2001 |

(Continued)

OTHER PUBLICATIONS

C.D. Fuerst et al., "Die-Upset Pr—Fe—B-Type Magnets From Melt-Spun Ribbons," Journal of Applied Physics, vol. 75, Apr. 15, 1994, pp. 4208-4213, XP002521581, Apr. 15, 1994.

(Continued)

*Primary Examiner* — Kaj K Olsen
*Assistant Examiner* — Alexander Polyansky
(74) *Attorney, Agent, or Firm* — Greenblum & Bernstein, P.L.C.

(57) ABSTRACT

A material for anisotropic magnet, comprising, (1) a Pr-T-B—Ga-based composition containing Pr: 12.5 to 15.0 atomic percent, B: 4.5 to 6.5 atomic percent, Ga: 0.1 to 0.7 atomic percent, and the balance of T and inevitable impurities, wherein T is Fe or obtained by substituting Co for a portion of the Fe; and having, (2) a degree of magnetic alignment of 0.92 or more, wherein the degree of magnetic alignment is defined by remanence (Br)/saturation magnetization (Js); and (3) a crystal grain diameter of 1 μm or less.

10 Claims, 9 Drawing Sheets

(51) Int. Cl.

| | |
|---|---|
| ***C21D 8/12*** | (2006.01) |
| ***C22C 38/00*** | (2006.01) |
| *B22F 3/24* | (2006.01) |
| *H01F 41/02* | (2006.01) |

(52) U.S. Cl.
CPC ..... *B22F 2998/10* (2013.01); *B22F 2999/00* (2013.01); *H01F 1/0571* (2013.01); *H01F 41/0273* (2013.01)

(56) References Cited

U.S. PATENT DOCUMENTS

| | | | | |
|---|---|---|---|---|
| 6,056,830 | A | 5/2000 | Honkura et al. | |
| 6,277,211 | B1 | 8/2001 | Panchanathan et al. | |
| 6,419,759 | B1 * | 7/2002 | Yang et al. | 148/302 |
| 6,444,052 | B1 | 9/2002 | Honkura et al. | |
| 6,709,533 | B2 | 3/2004 | Honkura et al. | |
| 2002/0036558 | A1 * | 3/2002 | Nakagawa et al. | 335/302 |
| 2002/0054824 | A1 * | 5/2002 | Tokoro et al. | 419/30 |
| 2002/0059965 | A1 | 5/2002 | Honkura et al. | |
| 2003/0047240 | A1 | 3/2003 | Honkura et al. | |
| 2006/0048855 | A1 * | 3/2006 | Honkura et al. | 148/105 |
| 2009/0123774 | A1 * | 5/2009 | Nishiuchi et al. | 428/566 |

FOREIGN PATENT DOCUMENTS

| | | |
|---|---|---|
| CN | 1345073 | 4/2002 |
| JP | 02-003210 | 1/1990 |
| JP | 08-273914 | 10/1996 |
| JP | H10-326705 | 12/1998 |
| JP | 11-329810 | 11/1999 |
| JP | 2006-203216 | 8/2006 |
| JP | 2008-172037 | 7/2008 |
| WO | 01/24201 | 4/2001 |

OTHER PUBLICATIONS

Gabay A et al., "Die-upset hybrid Pr—Fe—B Nanocomposite magnets," Applied Physics Letters, AIP, American Institute of Physics, Melville, NY, vol. 85, No. 3, Jan. 1, 2004, pp. 446-448, XP012063994, ISSN: 0003-6951, Jan. 1, 2004.

Extended European Search Report dated Feb. 11, 2010 for corresponding European Patent Application No. 10150072.6, and corresponding published EP application.

Chinese Office Action with English Translation in respect to Chinese Application No. 201410341682.2, dated Feb. 29, 2016.

US 6,599,373, 07/2003, Honkura et al. (withdrawn)

* cited by examiner

MATERIAL FOR ANISOTROPIC MAGNET AND METHOD OF MANUFACTURING THE SAME

This is a Continuation-in-part of application Ser. No. 12/392,329, filed Feb. 25, 2009. The application Ser. No. 12/392,329 is pending.

BACKGROUND OF THE INVENTION

1. Field of the Invention

The present invention relates to a material for anisotropic magnet that can be obtained by hot plastic deforming, and a method of manufacturing the same.

2. Description of the Related Art

Recently, for motors or electric generators, magnets (rare-earth magnets) including rare-earth elements, such as neodymium or samarium have been widely used. The reason the rare-earth magnets are used is that they have excellent magnetic properties and are relatively inexpensive. Coercivity (iHc) and remanence (Br) are considered as important factors in the magnetic properties.

The coercivity is the magnitude of magnetic field that is needed to make magnetization zero. In general, it has been known that heat resistance is excellent when the coercivity is large.

The remanence represents the magnitude of the maximum magnetization at H=0 of a magnet material. In the case that the remanence is large (high), it is possible to reduce the size of the apparatuses, such as an electric generator, and the cost of the magnets, and as a result, this is considerably advantageous.

Therefore, Nd (neodymium)-Fe (iron)-B (boron) magnets having high remanence have been the most widely used as rare-earth magnets.

On the other hand, a magnet alloy that can be obtained by applying hot plastic deforming to R (rare-earth elements)-Fe—B-based magnetic alloys has been known in the related art (see Laying-Open No. H11 (1999)-329810). In Laying-Open No. H11 (1999)-329810, it is described that an anisotropic magnet having excellent magnetic properties can be obtained by optimizing the composition of an R—Fe—B-based magnetic alloy and the process conditions.

Further, a magnet mainly using Pr (praseodymium) to improve coercivity has already been known (see Laying-Open No. H8 (1996)-273914). In Laying-Open No. H8 (1996)-273914, in consideration of ensuring workability in casting and hot rolling, and high coercivity, a magnet, in which the composition of Pr is limited within 15 to 17 atomic percent, is described (see Paragraph "0014"). Further, it has been known that a magnet having high coercivity can be obtained by applying appropriate heat treatment to a Pr—Fe—B-based alloy (see [Operation] in Laying-Open No. H2 (1990)-3210).

However, magnets in the related art have the following problems for use in motors that are used in a high-temperature environment.

Technically, according to magnetic properties of rare-earth magnets containing the main component of Pr or Nd, the coercivity decreases with the increase of remanence, while the remanence decreases with the increase of coercivity, which is a trade-off relationship. It is difficult to improve both of the remanence and the coercivity.

Therefore, the magnet described in Laying-Open No. H11 (1999)-329810 improves the maximum energy product ($(BH)_{max}$) by particularly increasing the remanence, however, has a problem in that it can not obtain sufficient coercivity. Further, the magnets described in Laying-Open No. H8 (1996)-273914 and Laying-Open No. H2 (1990)-3210 can obtain high coercivity, however, has a problem in that they can not necessarily obtain sufficient remanence.

[Patent document 1] Laying-Open No. H11 (1999)-329810
[Patent document 2] Laying-Open No. H8 (1996)-273914
[Patent document 3] Laying-Open No. H2 (1990)-3210

SUMMARY OF THE INVENTION

An object of the present invention is to improve coercivity of a material for anisotropic magnet containing the main component of Pr, without decreasing remanence.

In order to achieve the above object, a material for anisotropic magnet according to the present invention, includes the following configuration.

(1) The material for anisotropic magnet contains a Pr-T-B—Ga-based composition containing Pr: 12.5 to 15.0 atomic percent, B: 4.5 to 6.5 atomic percent, Ga: 0.1 to 0.7 atomic percent, and the balance of T and inevitable impurities, wherein T is Fe or obtained by substituting Co for a portion of the Fe.

(2) The material for anisotropic magnet has a degree of magnetic alignment of 0.92 or more, wherein the degree of magnetic alignment is defined by remanence (Br)/saturation magnetization (Js).

(3) The material for anisotropic magnet has a crystal grain diameter of 1 μm or less.

The material for anisotropic magnet may be configured such that Nd is substituted for a portion of the Pr, provided that the Pr is 50 atomic percent or more of all the rare-earth elements.

Further, the material for anisotropic magnet may be configured such that at least one element selected from a group of Dy and Tb is substituted for a portion of the Pr (or a portion of the Pr and the Nd added if necessary).

Further, the material for anisotropic magnet may further contain at least one element selected from a group of Cu and Al.

A method of manufacturing a material for anisotropic magnet of the present invention comprising:

dissolving an alloy having such composition that is mixed so as to be a material for anisotropic magnet of the present invention;

rapidly-quenching the molten alloy; pulverizing the ribbon obtained by the rapid-quenching;

cold-pressing the alloy powder obtained by the pulverizing;

pre-heating the cold-pressed body obtained by the cold-pressing, under a temperature of 500° C. or more and 850° C. or less;

hot-forming the cold-pressed body which is pre-heated;

performing a hot plastic deforming to the hot-formed body obtained by the hot-forming.

Since the material for anisotropic magnet according to the present invention contains Pr as the main component, which increases coercivity more than Nd, high coercivity can be obtained. Further, since the amount of Pr is limited within 12.5 to 15.0 atomic percent, the coercivity is improved while practical problems, such as an increase of difficulty in hot plastic deforming and gall to a mold, are not occurred.

The material for anisotropic magnet according to the present invention is obtained by performing cold-pressing, pre-heating, hot-forming, and hot plastic deforming to alloy powder having a predetermined composition. That is, the material for anisotropic magnet is formed in a polycrystalline body having crystal grains and grain boundary phases surrounding the crystal grains.

By performing pre-heating and hot-forming to the cold-pressed body, grain boundary phase liquefies, accordingly, densification of the material for magnet proceeds and the grain boundary phase that has liquefied surrounds the crystal grains. At this time, the axes of easy magnetization of the crystal grains are disposed in random directions. Successively, the hot plastic deforming is performed to the obtained hot-formed body, accordingly, the crystal grains are plastically deformed while being compressed in the pressing direction, and the axes of easy magnetization of the crystal grains are aligned in the pressing direction. As a result, the degree of magnetic alignment defined by remanence (Br)/saturation magnetization (Js) becomes 0.92 or more. Further, the degree of magnetic alignment becomes 0.95 or more by optimizing the manufacturing conditions.

In the present invention, the axes of easy magnetization become easy to be aligned in a predetermined direction, with the result that the remanence can be increased. The reason is considered as follows: when Pr is used as the main component of the material for anisotropic magnet, the melting point of the grain boundary phases is relatively reduced and the crystal grains can be smoothly rotated. That is, the present invention makes it possible to improve coercivity without decreasing remanence due to specific characteristics of Pr and specific alignment mechanism of Pr during the hot plastic deforming.

DETAILED DESCRIPTION OF THE PREFERRED EMBODIMENTS

Figure 1:
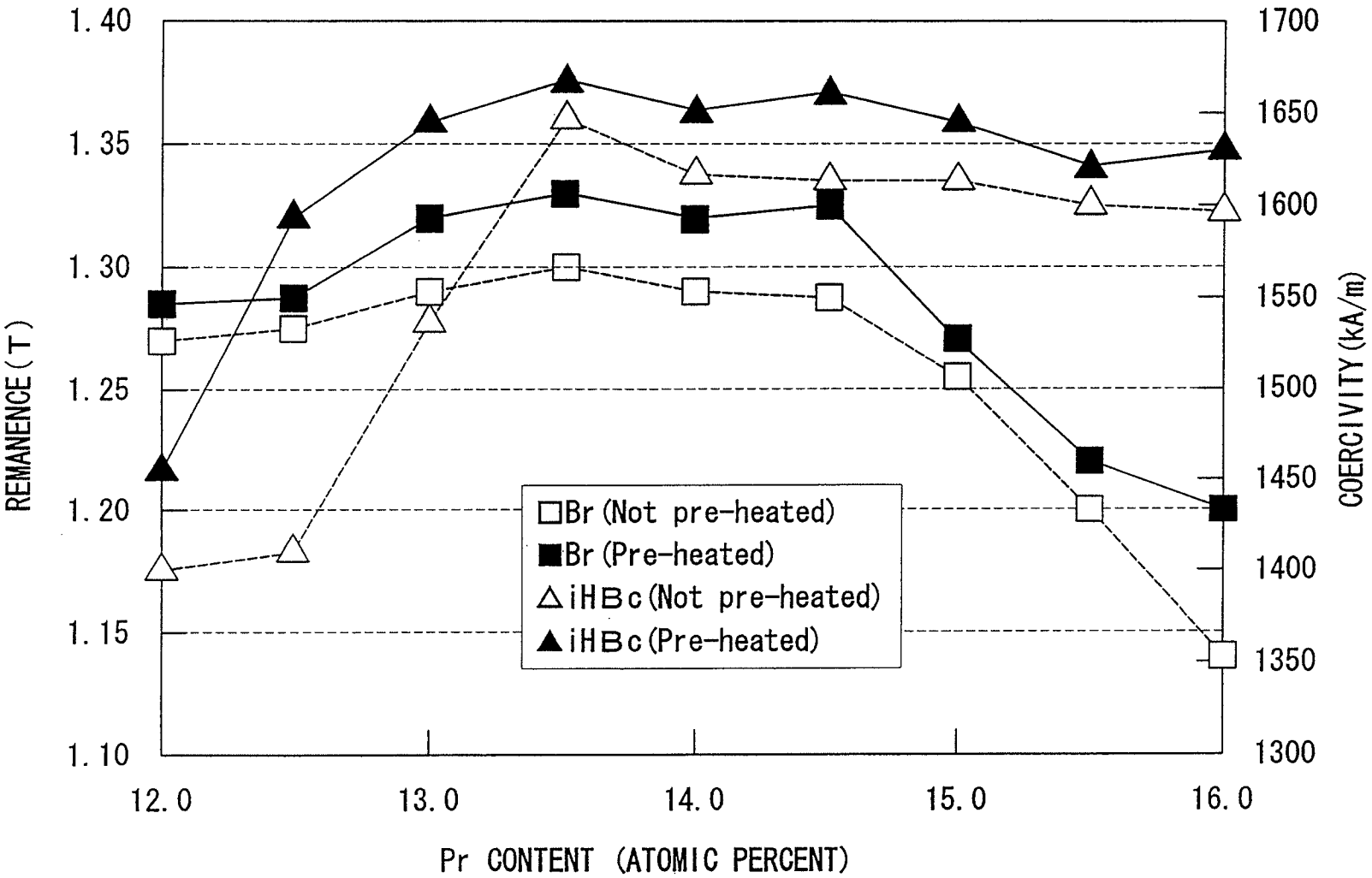
FIG. 1 is a graph illustrating the relationship between Pr content and coercivity (iHc) and the relationship between Pr content and remanence (Br)

An embodiment of the present invention is described hereafter in detail.

[1. Material for Anisotropic Magnet]

A material for anisotropic magnet according to the present invention has the following configuration.

[1.1 Composition]

The material for anisotropic magnet according to the present invention has a Pr-T-B—Ga-based composition. That is, the material for anisotropic magnet according to the present invention contains a predetermined amount of Pr, B, and Ga and the balances are T and inevitable impurities. The reason of range and limit of each element is as follows.

[1.1.1 Main Component]

(1) Pr: 12.5 to 15.0 Atomic Percent

When the Pr content is small, the coercivity (iHc) extremely decreases. Further, in the hot plastic deforming, a workpiece does not have sufficient fluidity, such that the deformation process is difficult. In addition, when the Pr content is small, the degree of magnetic alignment (Br/Js), which is described below, decreases. Therefore, the Pr content needs to be 12.5 atomic percent or more. The Pr content is more preferably 13.0 atomic percent or more, and further, more preferably 13.5 atomic percent or more.

In contrast, when the Pr content is excessive, the remanence (Br) extremely decreases. Further, in the hot plastic deforming, the workpiece is easily galled by a mold. In addition, when the Pr content is excessive, the degree of magnetic alignment (Br/Js) decreases. Therefore, the Pr content should be 15.0 atomic percent or less. The Pr content is preferably 14.5 atomic percent or less, and more preferably 14.0 atomic percent or less.

(2) B: 4.5 to 6.5 Atomic Percent

When the B content is small, the crystal grains of the material for anisotropic magnet grow, such that good alignment of the crystal grains cannot be obtained. Therefore, the B content needs to be 4.5 atomic percent or more. It is preferable that the B content is 5.0 atomic percent or more to improve the coercivity without decreasing the remanence.

In contrast, when the B content is excessive, an amount of the grain boundary phase decreases, accordingly, a B-rich phase, such as hard and brittle $PrFeB_4$, is created on the crystal boundaries, such that the alignment of the crystal grains becomes easy to be unstable. Therefore, the B content needs to be 6.5 atomic percent or less. It is preferable that the B content is 6.0 atomic percent or less to improve the coercivity without decreasing the remanence.

(3) Ga: 0.1 to 0.7 Atomic Percent

When the Ga content is small, the coercivity (iHc) decreases. Therefore, the Ga content needs to be 0.1 atomic percent or more. The Ga content is preferably 0.15 atomic percent or more, and more preferably 0.2 atomic percent or more. It is preferable that the Ga content is 0.4 atomic percent or more to improve the coercivity.

In contrast, when the Ga content is excessive, the coercivity (iHc) decreases on the contrary. Further, since Ga is expensive, unnecessarily adding Ga increases cost. Therefore, the Ga content needs to be 0.7 atomic percent or Tess. It is preferable that the Ga content is 0.5 atomic percent or less to improve the coercivity.

(4) T and Inevitable Impurities

The balances, other than Pr, B, and Ga, are T and inevitable impurities.

The T may be formed of only Fe or obtained by substituting Co for a portion of Fe.

When Co is substituted for a portion of Fe, corrosion resistance and thermal stability are improved. However, when the amount of Co substituted for Fe is excessive, the saturation magnetization and the coercivity are decreased. Therefore, it is preferable that the amount of Co content to the entire amount of elements in the material for anisotropic magnet is 6.0 atomic percent or less.

[1.1.2 Subsidiary Element]

(1) Nd

Nd may be substituted for a portion of Pr. Because, in this case, it is preferable to use under a condition which requires high-temperature performance. However, when the Nd content is excessive, the coercivity decreases. Therefore, when Nd is contained, it is preferable that the total amount of Pr and Nd is 12.5 to 15.0 atomic percent while Nd is substituted for a portion of Pr so that the Pr content may become 50 atomic percent or more of all the rare-earth elements.

In detail, it is preferable that the Nd content to the total amount of elements in the material for anisotropic magnet is 6.0 atomic percent or less. The Nd content is preferably 5.0 atomic percent or less, more preferably 4.0 atomic percent or less, and more preferably 2.0 atomic percent or less.

(2) Dy and Tb

At least one element selected from a group of Dy and Tb may be substituted for a portion of Pr. Further, when both of Pr and Nd are contained, at least one element selected from a group of Dy and Tb may be substituted for a portion of Pr and/or Nd.

When Dy and/or Tb are substituted for a portion of Pr (and Nd), the magnetic anisotropy increases and the coercivity is improved. Accordingly, the material for anisotropic magnet containing Dy and/or Tb is suitable for a magnet material that is used at high temperature.

To improve the coercivity, it is preferable that the total amount of Pr (and Nd), Dy, and Tb is 12.5 to 15.0 atomic percent while the Dy and Tb contents to the total amount of elements in the material for anisotropic magnet are each 1.0 atomic percent or more.

On the other hand, when the substitution amounts of Dy and/or Tb are excessive, remanence may be decreased. Therefore, it is preferable that the total amount of Pr (and Nd), Dy, and Tb is 12.5 to 15.0 atomic percent while the Dy and Tb contents to the total amount of elements in the material for anisotropic magnet are each 2.0 atomic percent or less.

In addition to substitution by Nd, or instead of that, when substituted by Dy and/or Tb, the total amount of Pr is preferably above 50.0 atomic percent or more of all the rare-earth elements.

(3) Cu and Al

Instead of substituting any one or more of Dy and Tb for a portion of Pr (and Nd), or in addition to that, the material for anisotropic magnet may further contain at least one element selected from a group of Cu and Al.

When Cu and/or Al are added in the material for anisotropic magnet having a predetermined composition, the coercivity is improved. The reason is considered as follows: the melting points of the grain boundary phase is dropped by adding Cu and/or Al, causing the grain boundary phase to be formed uniformly around the main phase and; it becomes correspondingly difficult to receive a magnetic field from the outside. When the Cu and Al contents are small, magnetic properties of the main phase are not damaged by addition of them.

On the other hand, when the Cu and Al contents are excessive, the remanence is decreased. Therefore, when only Cu is added, the Cu content is preferably 1.0 atomic percent or less and more preferably 0.5 atomic percent or less. Similarly, when only Al is added, the Al content is preferably 1.0 atomic percent or less and more preferably 0.5 atomic percent or less.

Further, when both of Cu and Al are added, the total amount of Cu and Al contents is preferably 2.0 atomic percent or less and more preferably 1.5 atomic percent or less.

[1.2 Structure]

The material for anisotropic magnet according to the present invention can be obtained by rapidly-quenching a molten alloy having the above composition; pulverizing the ribbon obtained by the rapid-quenching; cold-pressing the alloy powder obtained by the pulverizing; pre-heating the cold-pressed body obtained by the cold-pressing; hot-forming the cold-pressed body which is pre-heated; and performing hot plastic deforming to the hot-formed body. As a result, the material for anisotropic magnet becomes a polycrystalline body having the crystal grains formed by the main phase ($R_2T_{14}B$ phase (R is a rare-earth element)) and grain boundary phase surrounding the crystal grains.

By optimizing the composition and manufacturing conditions, which is described below, it is possible to improve the remanence while keeping the coercivity high. The reason is considered as follows: the degree of alignment of the axis of easy magnetization is improved without growing the crystal grains and without increasing the oxygen content.

The crystal grain diameter of the main phase affects the coercivity. In general, the smaller the crystal grain diameter of the main phase is, the larger the coercivity becomes. In order to achieve high coercivity, the crystal grain diameter is preferably 1 μm or less. The crystal grain diameter is more preferably 500 nm or less and more preferably 300 nm or less and more preferably 200 nm or less.

The "crystal grain diameter" herein implies a value that is obtained by:

(a) photographing the ab surface of the crystal (a surface parallel with the pressing direction, e.g., the longitudinal cross section of an extruded cylindrical magnet), (b) directly drawing one or plural lines across a total of one hundred crystal grains on the photographed image, perpendicular to the pressing direction, and (c) dividing the total length of the lines crossing the hundred crystal grains into one hundred.

[1.3 Degree of Magnetic Alignment]

The degree of magnetic alignment implies a value that is defined by remanence (Br)/saturation magnetization (Js). Further, the saturation magnetization (Js) implies a force of spontaneous magnetization of a magnetic body, in other words, a value where magnetization does not increase when a magnetic field is applied to the magnetic body from the outside.

In the case of a specimen in which the axis of easy magnetization (c-axis) of the $R_2Fe_{14}B$ crystal (R is rare-earth element) is completely aligned, even if the external magnetic field is removed after magnetization is once performed up to the saturation magnetization Js, it is expected that the remanence Br almost becomes the same as Js. That is, the degree of magnetic alignment becomes 1 in a completely aligned specimen.

On the other hand, in the case of a specimen of which the axis of easy magnetization is inclined at a predetermined angle, even though the saturation magnetization is the same as the completely aligned specimen, the axis of easy magnetization considerably rotates during reduction of the external magnetic field, thereby decreasing magnetization. As a result, Js is larger than Br.

In the material for anisotropic magnet according to the present invention, the degree of magnetic alignment becomes 0.92 or more by optimizing the composition and manufacturing conditions. Further, the degree of magnetic alignment becomes 0.95 or more by optimizing the composition and manufacturing conditions.

[1.4 Coercivity and Remanence]

When the composition and the manufacturing conditions are optimized, the material for anisotropic magnet of the present invention achieves 1600 kA/m or more of coercivity (iHc). When the composition and the manufacturing conditions are further optimized, the coercivity (iHc) becomes 1700 kA/m or more, 1800 kA/m or more, 1900 kA/m or more, or, 2000 kA/m or more.

Further, when the composition and the manufacturing conditions are optimized, the material for anisotropic magnet of the present invention achieves 1.20 T or more of remanence (Br).

[2. Method of Manufacturing Material for Anisotropic Magnet]

A method of manufacturing a material for anisotropic magnet according to the present invention includes a dissolving/rapid-quenching/pulverizing process, cold-pressing process, a pre-heating process, a hot-forming process, and a hot plastic deforming process.

[2.1 Dissolving/Rapid-Quenching/Pulverizing Process]

The dissolving/rapid-quenching/pulverizing process is a process that dissolves an alloy having a predetermined composition, obtains a ribbon by rapidly-quenching the molten metal, and pulverizes the obtained ribbon.

The method of dissolving a raw material is not specifically limited and may be a method that can obtain a molten metal that is uniform in composition and has fluidity where rapid-quenching solidification is possible. In the case of the material for anisotropic magnet according to the present invention, it is preferable that the temperature of the molten metal is 1000° C. more.

The rapid-quenching of the molten metal is generally performed by dropping the molten metal to a rotating roll (Cu roll) having high heat-removal property. The cooling speed of the molten metal can be controlled according to the circumferential velocity of the rotating roll and the amount of molten metal dropped. The circumferential velocity is generally approximately 10 to 30 m/s.

By pulverizing the ribbon obtained by the rapid-quenching, alloy powder in a flake form composed of fine crystal grains of approximately 20 nm is, obtained.

[2.2 Cold-Pressing Process]

The cold-pressing process is a process that cold-presses the alloy powder obtained by the rapid-quenching and the pulverizing.

The cold-pressing is performed by filling the alloy powder in a mold at a room temperature and pressing it with a punch.

In general, the more the forming pressure increases, the higher is the possibility to obtain cold-pressed body having higher density. However, when the forming pressure is above a predetermine level, the density of the cold-pressed body is saturated, such that unnecessarily high pressing is not preferable. It is preferable to appropriately select the forming pressure, depending on the composition and the size of powder etc.

The pressing time is sufficient to be above, a time where the density of the cold-pressed body is saturated, which is generally 1 to 5 seconds.

[2.3 Pre-Heating Process]

The pre-heating process is a process that pre-heats the cold-pressed body obtained by the cold-pressing, under a temperature of 500° C. or more and 850° C. or less.

By combining the pre-heating with below-described hot-forming, the cold-pressed body can be continuously heated and pressed, accordingly, it is preferable as an industrial mass production method. Further, when the hot-forming is performed by optimizing the condition of the pre-heating, the formed-body which has such crystalline structure that is uniform and fine is obtained. There is such advantage that the degree of magnetic alignment is further improved when the hot plastic deforming is performed to this formed-body.

In the case of combining the pre-heating with the hot-forming, when the pre-heating temperature is excessively low, the grain boundary phase is not sufficiently liquefied during the hot-forming. As a result, crack may occur in the formed-body during the hot-forming. Therefore, it is preferable that the pre-heating temperature is 500° C. or more. More preferably, the pre-heating temperature is 600° C. or more, and more preferably 700° C. or more.

Still, in order to avoid the crack during the hot-forming, after inserting the formed-body into the mold, holding it until it reaches a predetermined temperature decreases productivity.

In contrast, when the pre-heating temperature is excessively high, the crystal grains grow. Further, in the case that the pre-heating is performed in the atmosphere, the higher the pre-heating temperature is, the more oxidized the material is, such that the oxygen content increases. Therefore, it is preferable that the pre-heating temperature is 850° C. or less. More preferably, the pre-heating temperature is 800° C. or less and more preferably 780° C. or less.

The pre-heating time may be a time in which the formed-body reaches the predetermined temperature. When the pre-heating time is excessively short, the grain boundary phase is not liquefied, causing crack to occur during the hot-forming. In contrast, excessive pre-heating becomes a reason that causes the crystal grains to grow. It is preferable to select an appropriate pre-heating time, depending on the size of the formed-body and the pre-heating temperature. In general, it is preferable that the larger the size of the formed-body is, the longer the pre-heating time is selected. Further, it is preferable that the lower the pre-heating temperature is, the longer the pre-heating time is selected.

The atmosphere of the pre-heating may be any one of an inert atmosphere, an oxidation atmosphere, and a reduction atmosphere. However, an increase of oxygen content decreases the magnetic properties. Therefore, it is preferable that the atmosphere of the pre-heating is the inert atmosphere or the reduction atmosphere.

[2.4 Hot-Forming Process]

The hot-forming process is a process that applies pressure to the cold-pressed body, which is pre-heated, under a hot condition, and densifies the magnet material.

In the present invention, "hot-forming" means so-called a hot-press method that is to apply pressure to a cold-pressed body, which is heated in a mold, with a punch. When pressure is applied to the cold-pressed body with using a hot-press method under hot condition, air-holes remained in the cold-pressed body disappear, accordingly, the cold-pressed body can be densified.

There are methods of hot-forming using the hot-press method as follows, in detail, (1) a first method of inserting a cold-pressed body into a mold and then applying a predetermined pressure to the cold-pressed body for a predetermined time before or after the temperature of the cold-pressed body and the mold reaches a predetermined temperature, or while the temperature increases, and (2) a second method of pre-heating the cold-pressed body, inserting the cold-pressed body, which is pre-heated, into a mold heated at a predetermined temperature, and then applying a predetermined pressure to the cold-pressed body for a predetermined time.

In the present invention, the second method is applied.

Optimal conditions for the hot-press are selected, depending on the composition or required properties.

In general, when the temperature in the hot-press is excessively low, the grain boundary phase is not sufficiently liquefied. As a result, densification is not sufficient or, occasionally, cracks may occur in the formed-body after the hot-forming process. Therefore, it is preferable that the temperature of the hot-press is 750° C. or more.

In contrast, when the temperature in the hot-press is excessively high, the crystal grains grow and the magnetic properties are decreased. Therefore, it is preferable that the temperature in the hot-press is 850° C. or less.

In general, the higher the pressure during the hot-press is, the more the densification of the formed-body proceeds. Meanwhile, excessive pressing is not practically advantageous because the effect is saturated. It is preferable to appropriately select the pressure during the hot-press, depending on the composition and the size of powder and temperature conditions etc.

In general, the longer the pressurizing time is, the more the densification of the formed-body proceeds. Meanwhile, the pressurizing time longer than necessary causes the crystal grains to grow and the magnetic properties to decrease. It is preferable to select the pressing time, depending on the composition, the size of powder, and temperature conditions, etc.

The atmosphere of the hot-press may be any one of an inert atmosphere, an oxidation atmosphere, and a reduction atmosphere. However, an increase of oxygen content decreases the magnetic properties. Therefore, it is preferable that the atmosphere of the hot-press is the inert atmosphere or the reduction atmosphere.

[2.5 Hot Plastic Deforming]

The hot plastic deforming is a process that plastically deforms the densified hot-formed body into a predetermined shape.

The hot plastic deforming is not specifically limited and can use various methods according to the objects.

There are methods for hot plastic deforming, in detail, (1) hot extrusion (including backward extrusion and forward extrusion) and (2) hot upsetting.

Considering improvement of the industrial productivity, the hot extrusion is particularly useful in the methods for hot plastic deforming.

The processing temperature may be a temperature where the plastic deformation is possible without crack occurring in the formed-body. In general, when the processing temperature is excessively low, the grain boundary phase is not sufficiently liquefied, such that crack may occur in the formed-body. Therefore, it is preferable that the processing temperature is 750° C. or more In contrast, when the processing temperature is excessively high, the crystal grains grow and the magnetic properties are decreased. Therefore, it is preferable that the processing temperature is 850° C. or less.

The atmosphere of the hot plastic deforming may be any one of an inert atmosphere, an oxidation atmosphere, and a reduction atmosphere. However, an increase of oxygen content decreases the magnetic properties. Therefore, it is preferable that the atmosphere of the hot plastic deforming is the inert atmosphere or the reduction atmosphere.

After the hot plastic deforming, by performing a post-process if necessary, a magnet material having desired composition and shape is obtained.

[3. Effect of Material for Anisotropic Magnet and Effect of Method of Manufacturing the Same]

Figure 6:
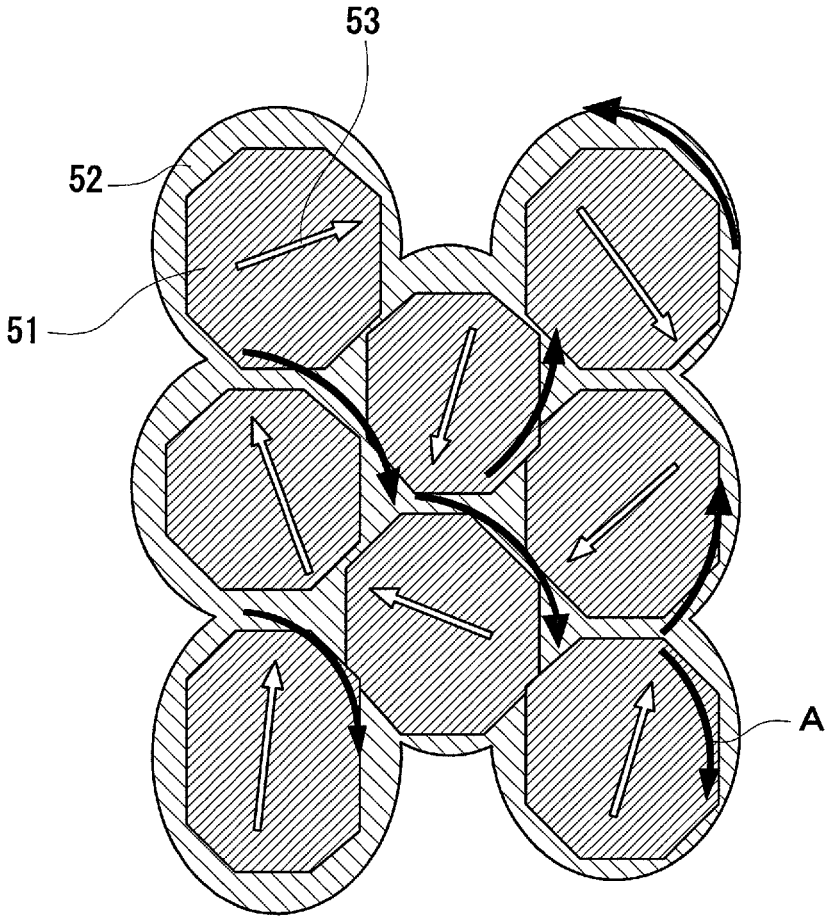
FIG. 6 is a view showing a schematic view illustrating the internal condition of a hot-formed body.

The alloy powder obtained by rapidly-quenching/solidifying and pulverizing is cold-pressed, thus the cold-pressed body is obtained. And then the cold-pressed body is preheated and hot-formed, with the result that the dense hot-formed body is obtained. FIG. 6 is a schematic view illustrating the internal condition of the hot-formed body. As shown in detail in FIG. 6, the inside of the hot-formed body is composed of crystal grains 51 and grain boundary phases 52. When the temperature of the hot-formed body is over approximately 600° C.-700° C. during the hot-forming, the grain boundary phase 52 starts to liquefy. Further, when the heating temperature is over approximately 700° C.-800° C., the crystal grain 51 becomes surrounded by the liquefied grain boundary phase 52.

In this state, the crystal grain 51 can rotate in the direction indicated by a black arrow denoted by A. However, since the amount of compressive deformation is small during the hot-forming, axes of easy magnetization 53 (white arrows) existing in the crystal grains 51 have such directions of magnetization (i.e. directions of N-poles and S-poles) that remain non-uniform state as they are (isotropic state). Therefore, in general, the axes of easy magnetization 53 do not become such state that is uniform in a predetermined direction (anisotropic state).

Next, by performing the hot plastic deforming to the obtained hot-formed body, the hot-formed body is plastically deformed and a magnet material having a desired shape is obtained.

When the hot-formed body is heated, the grain boundary phases liquefy and the crystal grains can rotate. In this state, when the hot plastic deforming is performed, the crystal grains are plastically deformed while being compressed in the pressing direction and the axes of easy magnetization are aligned in the pressing direction.

Figure 7:
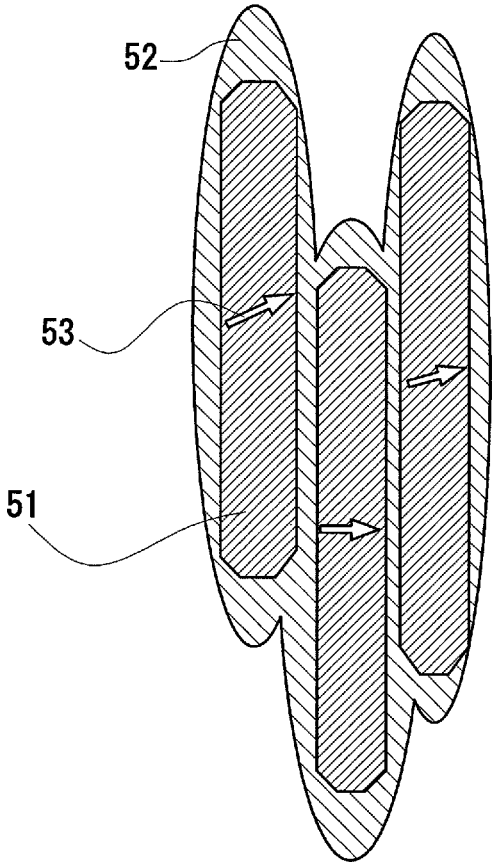
FIG. 7 is a view showing a schematic view illustrating the internal condition of a cylindrical formed-body.

For example, by performing hot backward extrusion to the hot-formed body, a cylindrical formed-body with a bottom is obtained. FIG. 7 is a schematic view illustrating the internal condition of the cylindrical formed-body. The right direction in FIG. 7 is the radial direction of the cylindrical formed-body.

In the case that the cylindrical formed-body is manufactured by the hot backward extrusion, a punch is inserted along an axial direction, but the pressing direction of the material is the radial direction. Therefore, when the backward extrusion is performed, so that the crystal grains 51 surrounded by the liquefied grain boundary phases 52 are compressed in the radial direction. Further, simultaneously, the axes of easy magnetization 53 rotate so as to be aligned in the radial direction. As a result, as shown in FIG. 7, the cylindrical formed-body having such axes of easy magnetization 53 that are aligned in the radial direction is obtained.

Since the material for anisotropic magnet according to the present invention contains Pr as the main component, it has high magnetic alignment (axes of easy magnetization 53 are easily arranged). It is assumed that the reason why the magnetic alignment becomes high is that the melting point of the grain boundary phase 52 drops to relatively low temperature when Pr is contained as the main component. That is, it is considered to be because of the specific alignment mechanism of Pr in which the crystal grains 51 easily rotate by performing the hot plastic deforming at a high temperature.

That is, according to the material for anisotropic magnet of the present invention, it is possible to improve coercivity without decreasing the remanence, by utilizing the characteristics of the element Pr and the specific alignment mechanism of Pr during the hot plastic deforming.

Further, in the case that the hot-forming is performed by the hot-press method, it is possible to further improve the remanence while keeping the coercivity high, by optimizing the manufacturing conditions. In particular, by pre-heating the cold-pressed body at a predetermined temperature and performing hot-press to the cold-pressed body in a mold heated at a predetermined temperature, with the result that the coercivity is improved than the case of not performing the pre-heating, and a magnet material having the degree of magnetic alignment of 0.92 or more, further 0.95 or more is obtained.

The reasons are considered as follows:

(1) when the pre-heating is performed at a predetermined temperature, the cold-pressed body is uniformly heated up to near a temperature of a mold, and distribution of a temperature of a magnetic material during hot plastic deforming becomes uniform, accordingly a time needed to perform the hot-forming is shortened, with the result that a hot-formed body which has such structure that is uniform and fine can be obtained, and (2) when hot plastic deforming is performed to the hot formed-body in which the crystal grains have been made to be fine and uniform, c-axes (axes of easy magnetization of the crystal grains) of $R_2Fe_{14}B$ become more easily aligned in a pressing direction remaining as the crystal grains are fine.

EXAMPLES

Example 1.1

[1. Manufacturing Specimen]

A molten alloy having a predetermined composition was rapidly-quenched. Then the obtained ribbon was pulverized, thereby alloy powder was obtained. The alloy powder was cold-pressed and the cold-pressed body was hot-formed. Further, hot plastic deforming was applied to the hot-formed body, with the result that a material for anisotropic magnet was obtained.

The composition of the alloy was $Pr_xFe_{94.05-x}B_{5.5}Ga_{0.45}$ (x=12.0, 12.5, 13.0, 13.5, 14.0, 14.5, 15.0, 15.5, 16.0, including inevitable impurities).

Further, condition of pre-heating and hot-forming are respectively as follows:

(1) (in the case that pre-heating is performed) pre-heating of 750° C.×10 minutes, and hot-press of 815° C. (a temperature of a mold); or, (2) (in the case that pre-heating is not performed) hot-press of 850° C. (a temperature of a mold).

[2. Method of Test]

[2.1 Magnetic Property]

The material for anisotropic magnet was magnetized and the magnetic properties were measured by using a direct current BH tracer.

[2.2 Degree of Magnetic Alignment]

The material for anisotropic magnet was magnetized and the degree of magnetic alignment was measured by using a pulse-typed high-magnetic field meter (magnetic field: 3988 kA/m).

[3. Result]

FIG. 1 illustrates the relationship between the Pr content and the coercivity (iHc) and the relationship between the Pr content and the remanence (Br).

It can be seen from FIG. 1 that, (1) in the case that the pre-heating is not performed, when the Pr content is under 13 atomic percent, the coercivity (iHc) decreases considerably and plastic deforming is difficult;

(2) in the case that the pre-heating is not performed, when the Pr content is over 15 atomic percent, the remanence (Br) decreases considerably and gall to the mold easily occurs;

(3) in the case that the pre-heating is performed, when the Pr content is 12.5 atomic percent or more, the coercivity (iHc) is higher than the case of not performing the pre-heating, further plastic-deforming is possible; and (4) in the case that the pre-heating is performed, the remanence (Br) is improved better than the case of not performing the pre-heating.

Figure 2:
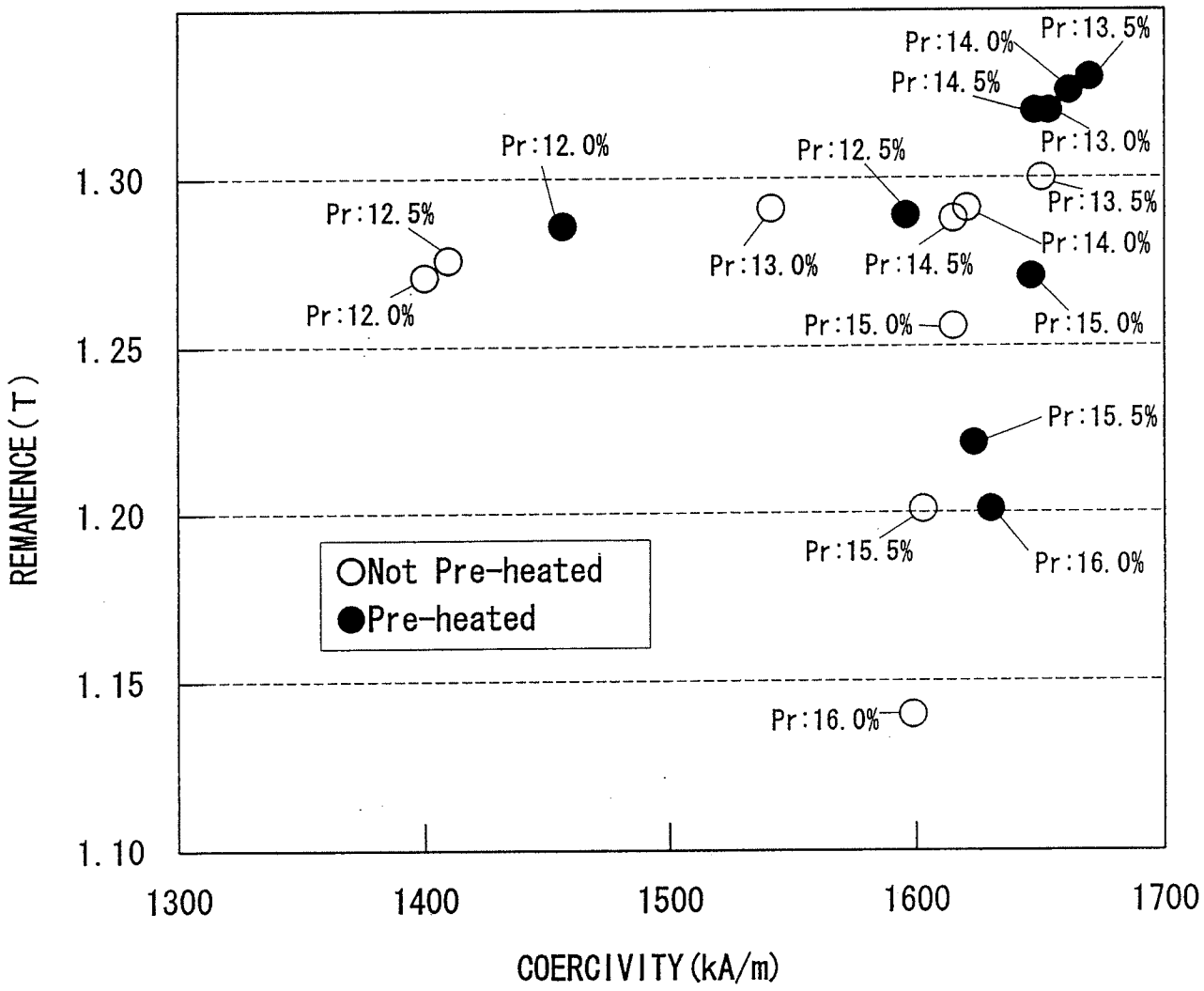
FIG. 2 is a graph illustrating the relationship of Pr content-coercivity (iHc)-remanence (Br)

FIG. 2 illustrates the relationship of Pr content-coercivity (iHc)-remanence (Br). It is shown in FIG. 2 that the magnetic property becomes better toward the right upper portion.

It can be seen from FIG. 2 that, (1) in the case that the pre-heating is not performed, the Pr content where both of coercivity and remanence are excellent is 13.0 to 14.5 atomic percent, and more preferably 13.5 to 14.0 atomic percent; and (2) in the case that the pre-heating is performed, the Pr content where both of coercivity and remanence are excellent is enlarged within the range of 12.5 to 15.0 atomic percent.

Figure 3:
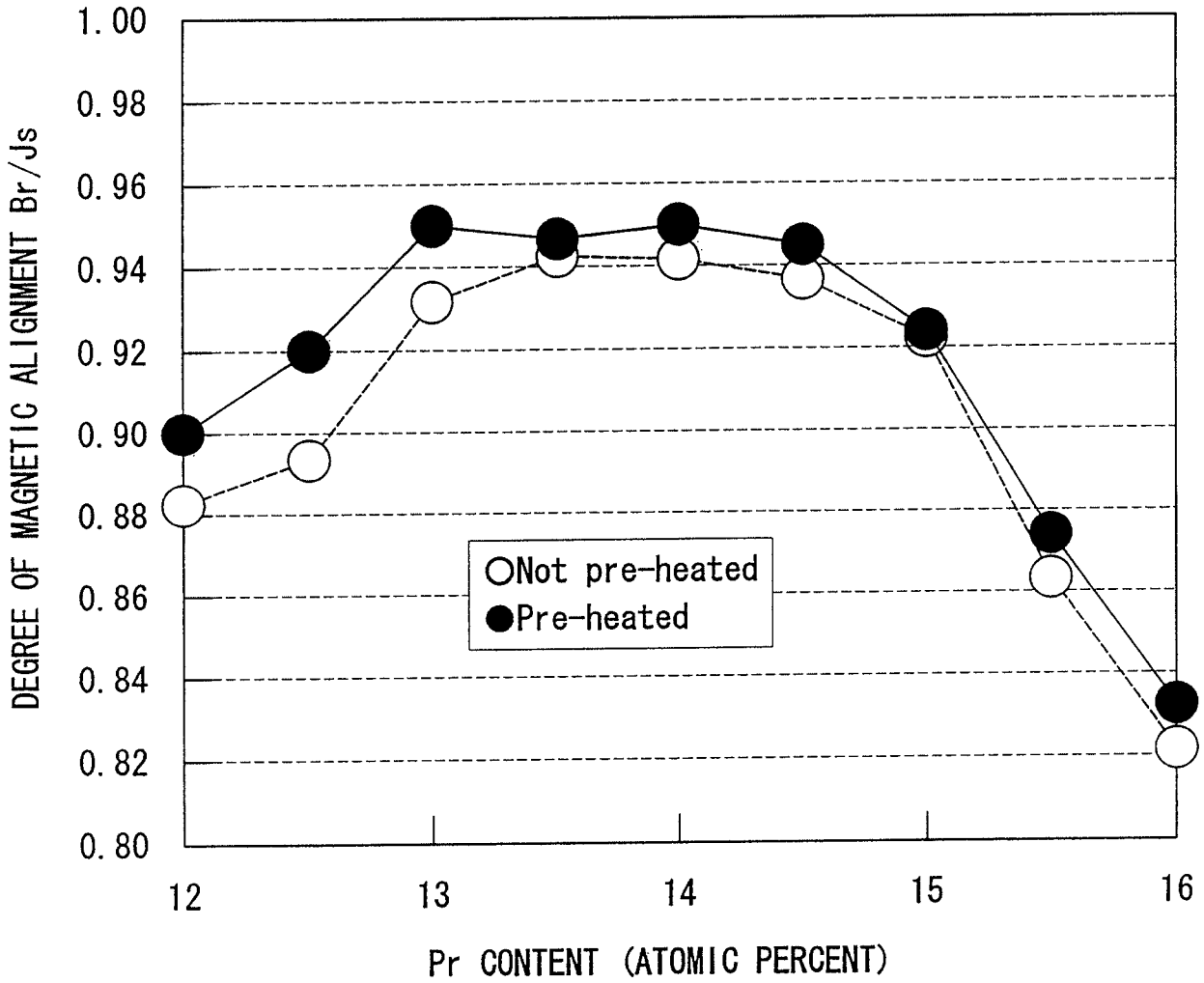
FIG. 3 is a graph illustrating the relationship between Pr content and the degree of magnetic alignment Br/Js.

FIG. 3 illustrates the relationship between the Pr content and the degree of magnetic alignment Br/Js.

It can be seen from FIG. 3 that, (1) in the case that the pre-heating is not performed, the degree of magnetic alignment decreases at any case when the Pr content is under 13 atomic percent and over 15 atomic percent;

(2) in the case that the pre-heating is performed, the degree of magnetic alignment of 0.92 or more is obtained when the Pr content is within the range of 12.5 to 15 atomic percent.

Example 1.2

[1. Manufacturing Specimen]

A material for anisotropic magnet was manufactured in the same method as the example 1.1, except that the composition was $Pr_{13.09}Fe_{81.51-y}B_{5.4}Ga_y$ (y=0, 0.1, 0.2, 0.3, 0.4, 0.5, 0.6, 0.7, 0.8, including inevitable impurities).

[2. Method of Test]

The material for anisotropic magnet was magnetized and the magnetic properties were measured by using a direct current BH tracer.

[3. Result]

Figure 4:
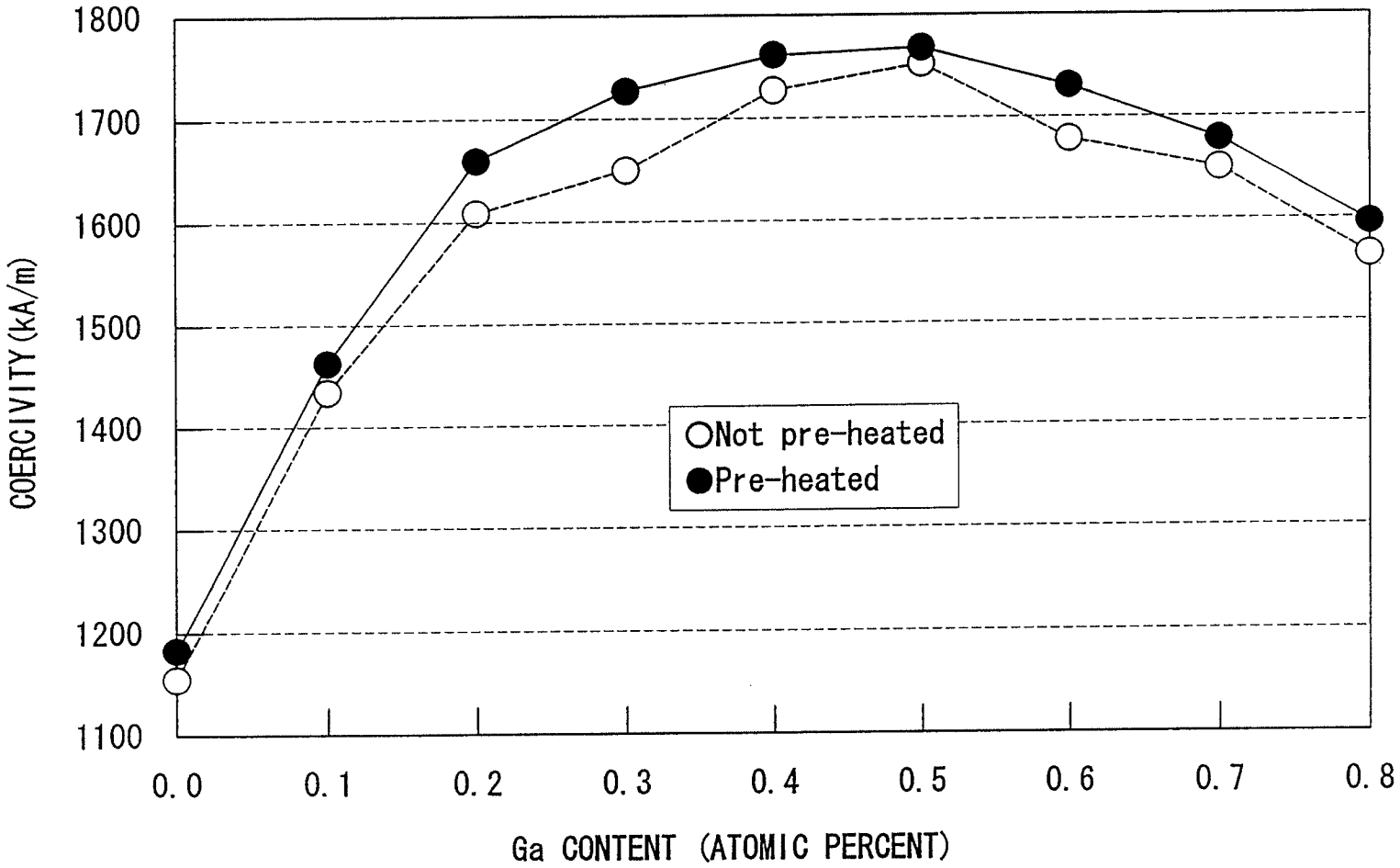
FIG. 4 is a graph illustrating the relationship between Ga content and coercivity (iHc)

FIG. 4 illustrates the relationship between the Ga content and the coercivity (iHc).

It can be seen from FIG. 4 that, (1) when the Ga content is under 0.1 atomic percent, the coercivity (iHc) extremely decreases;

(2) when the Ga content is over 0.7 atomic percent, the coercivity (iHc) decreases;

(3) in order to achieve high coercivity, it is preferable that the Ga content is 0.2 to 0.7 atomic percent and more preferably 0.4 to 0.5 atomic percent; and (4) in the case that the pre-heating is performed, coercivity is higher than the case of not performing the pre-heating.

Examples 2.1 to 2.21

Comparative Examples 2.1 to 2.5

[1. Manufacturing Specimen]

Figure 5:
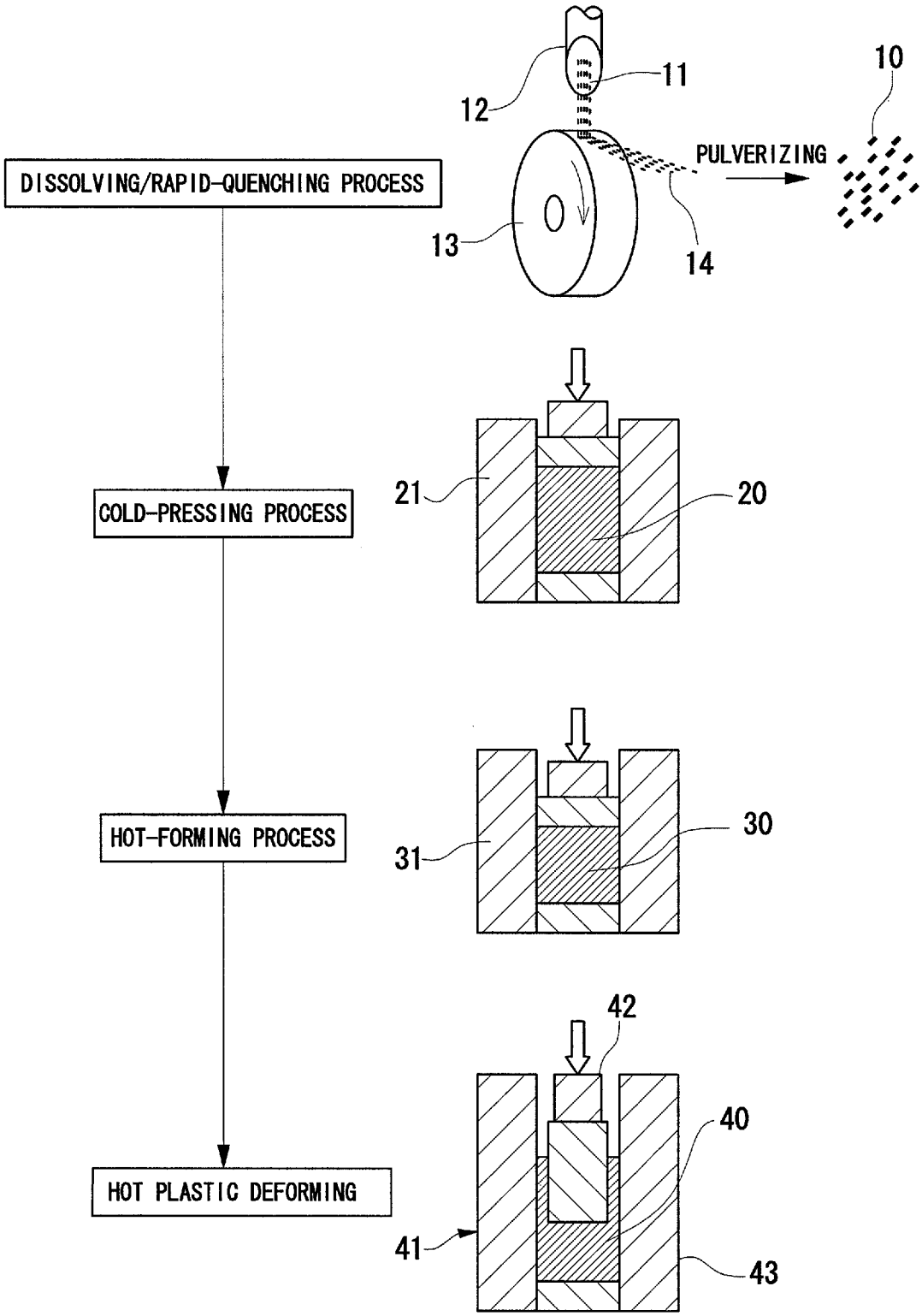
FIG. 5 is a view illustrating processes of a method of manufacturing a material for anisotropic magnet.

In accordance with the compositions (Examples 2.1 to 2.21, Comparative examples 2.1 to 2.5) shown in Table 1, material for anisotropic magnets were manufactured by the following manufacturing methods. FIG. 5 illustrates the processes of a method of manufacturing a material for anisotropic magnet.

[1.1 Dissolving/Rapid-Quenching/Pulverizing Process]

Predetermined amounts of various components of alloy materials were mixed and dissolved at 1000° C. or more. The molten alloy 11 was dropped and rapidly-quenched from an orifice 12 to a rotating roll 13 having high heat-removal property, and a ribbon 14 was manufactured. The circumferential speed of the rotating roll 13 was 18 to 20 m/s. The ribbon 14 was pulverized, thereby alloy powder 10 of flake form composed of fine crystal grains of 0.02 μm (20 nm) was obtained.

[1.2 Cold-Pressing Process]

Alloy powder 10 of 56 g was set in a cold press 21. The alloy powder was pressed in a cylindrical shape by applying pressure of approximately 5.1 t/cm$^2$ (5.0×10$^2$ MPa) from 1 to 5 seconds, with the result that a cold-pressed body 20 (cylindrical pressed-body having an outer diameter of 22.8 mm and a height of 30 mm) was obtained.

[1.3 Hot-Forming Process]

The cold-pressed body 20 was pre-heated for 10 minutes at 750° C. under an Ar-atmosphere. Successively, the cold-pressed body 20, which was pre-heated, was set in a hot-press 31. The cold-pressed body 20 was heated at 815° C. (a temperature of a mold) under an Ar-atmosphere and then formed in a cylindrical shape by applying pressure of 4 t/cm$^2$ (3.92 MPa) for approximately 20 seconds, with the result that a hot-formed body 30 (cylindrical formed-body having an outer diameter of 22.8 mm and a height of 20 mm) was obtained.

[1.4 Backward Extrusion]

The hot-formed body 30 was set in a backward extruder 41 and the backward-extruding was performed at 860° C. (a temperature of a mold) in the atmosphere, with the result that a material for anisotropic magnet 40 (cylindrical formed-body having an outer diameter of 22.8 mm, an inner diameter of 18.8 mm, and a height of 40 mm) was obtained.

When the hot-formed body 30 is inserted into a mold 43 and extruded backward (upward in FIG. 5) by a punch 42 smaller in diameter than the hot-formed body 30, the hot-formed body 30 is extruded into the groove between the punch 42 and the mold 43, in the opposite direction to the moving direction of the punch 42. As a result, a cylindrical formed-body 40 with a bottom is obtained.

The bottom of the obtained cylindrical formed-body 40 was cut off, and then the cylindrical formed-body 40 was magnetized in the radial direction, with the result that a ring-shaped magnet was obtained.

[2. Method of Test]

[2.1 Composition Analysis]

The composition of the alloy powder was measured by ICP analysis.

[2.2 Degree of Magnetic Alignment]

The degree of magnetic alignment Br/Js of the obtained ring-shaped magnet was measured by using a pulse-typed high-magnetic field meter (magnetic field: 3988 kA/m). The measurement was applied to a disc-shaped specimen having a diameter of approximately 5 mm that was cut off from the side of the magnetized ring-shaped magnet.

[2.3 Magnetic Property]

Coercivity (iHc) and remanence (Br) of the obtained ring-shaped magnet were measured by using a direct current BH tracer. The measurement was applied to a disc-shaped specimen having a diameter of approximately 5 mm that was cut off from the side of the magnetized ring-shaped magnet, as in the measurement of the degree of magnetic alignment.

Table 1 shows the measured results.

TABLE 1

| | Composition (atomic percent) | | | | | | | | | | | Magnetic property | |
|---|---|---|---|---|---|---|---|---|---|---|---|---|---|
| | Pr | Nd | Dy | Tb | Fe | Co | B | Ga | Cu | Al | Br/Js | Br (T) | iHc (kA/m) |
| Example 2.1 | 13.55 | — | — | — | bal | 5.95 | 5.76 | 0.55 | — | — | 0.921 | 1.294 | 1707 |
| Example 2.2 | 13.57 | — | — | — | bal | — | 5.69 | 0.43 | — | — | 0.941 | 1.312 | 1726 |
| Example 2.3 | 13.29 | — | — | — | bal | — | 5.51 | 0.42 | — | 0.38 | 0.935 | 1.271 | 1745 |
| Example 2.4 | 13.62 | — | — | — | bal | — | 5.76 | 0.35 | 0.35 | 0.63 | 0.930 | 1.276 | 1749 |
| Example 2.5 | 13.12 | — | 0.12 | — | bal | — | 5.56 | 0.43 | — | — | 0.936 | 1.311 | 1610 |
| Example 2.6 | 13.27 | — | 0.12 | — | bal | — | 4.86 | 0.23 | — | — | 0.952 | 1.221 | 1617 |
| Example 2.7 | 13.36 | — | 0.12 | — | bal | — | 5.57 | 0.43 | — | — | 0.933 | 1.253 | 1654 |
| Example 2.8 | 13.35 | — | 0.13 | — | bal | — | 5.46 | 0.20 | — | — | 0.945 | 1.283 | 1724 |
| Example 2.9 | 13.39 | — | 0.13 | — | bal | — | 5.58 | 0.39 | — | — | 0.942 | 1.289 | 1752 |
| Example 2.10 | 13.32 | — | 0.31 | — | bal | — | 5.76 | 0.43 | — | 0.46 | 0.939 | 1.283 | 1830 |
| Example 2.11 | 13.17 | — | 0.61 | — | bal | — | 5.78 | 0.41 | 0.35 | 0.63 | 0.927 | 1.323 | 1953 |
| Example 2.12 | 12.65 | — | 0.62 | — | bal | 5.92 | 5.41 | 0.55 | — | — | 0.954 | 1.290 | 1733 |
| Example 2.13 | 12.72 | — | 0.62 | — | bal | 2.99 | 5.53 | 0.41 | 0.33 | — | 0.948 | 1.281 | 1822 |
| Example 2.14 | 12.46 | — | 0.99 | — | bal | — | 5.53 | 0.41 | — | — | 0.937 | 1.237 | 1982 |
| Example 2.15 | 12.21 | — | 1.51 | — | bal | — | 5.66 | 0.43 | — | — | 0.928 | 1.243 | 2058 |
| Example 2.16 | 12.18 | — | 1.52 | — | bal | — | 5.25 | 0.24 | 0.15 | — | 0.949 | 1.231 | 2198 |
| Example 2.17 | 12.15 | — | 1.52 | — | bal | — | 5.36 | 0.25 | — | — | 0.953 | 1.287 | 2157 |
| Example 2.18 | 12.04 | — | 1.53 | — | bal | — | 5.43 | 0.49 | — | — | 0.946 | 1.269 | 2145 |
| Example 2.19 | 12.56 | — | — | 1.04 | bal | — | 5.54 | 0.42 | — | — | 0.955 | 1.261 | 2229 |
| Example 2.20 | 11.02 | 1.35 | 1.47 | — | bal | — | 5.60 | 0.52 | — | — | 0.942 | 1.247 | 2175 |
| Example 2.21 | 9.44 | 1.89 | 1.54 | — | bal | — | 5.56 | 0.54 | — | — | 0.948 | 1.250 | 2157 |
| Comparative Example 2.1 | — | 13.64 | — | — | bal | 5.98 | 5.70 | 0.77 | — | — | 0.896 | 1.242 | 1514 |
| Comparative Example 2.2 | — | 12.70 | 0.63 | — | bal | 6.03 | 5.16 | 0.56 | — | — | 0.903 | 1.280 | 1573 |
| Comparative Example 2.3 | — | 13.18 | 0.13 | — | bal | — | 5.72 | 0.43 | — | — | 0.898 | 1.324 | 1450 |
| Comparative Example 2.4 | — | 12.66 | 0.63 | — | bal | 2.95 | 5.39 | 0.58 | — | — | 0.904 | 1.284 | 1537 |
| Comparative Example 2.5 | — | 13.25 | 0.13 | — | bal | — | 5.49 | 0.41 | — | — | 0.905 | 1.295 | 1468 |

[3. Examination]

As shown in detail in Table 1, all of the degrees of magnetic alignment Br/Js in the Examples 2.1 to 2.21 are high value of 0.92 or more, whereas all of the degrees of magnetic alignment Br/Js in the Comparative examples 2.1 to 2.5 are less than 0.92. Further, the each remanence (Br) in the Examples 2.1 to 2.21 is the same as or more than the each remanence (Br) in the Comparative examples 2.1 to 2.5.

This is assumed because the degree of magnetic alignment was improved by the specific alignment mechanism of Pr and appropriate pre-heating during the hot plastic deforming.

All of the coercitivities (iHc) in the Examples 2.1 to 2.21 where Pr is contained as the main component are 1600 kA/m or more On the other hand, all of the coercitivities (iHc) in the Comparative examples 2.1 to 2.5 where Nd is contained as the main component are less than 1600 kA/m. This is because the anisotropic magnetic field of a $Pr_2Fe_{14}B$-type composition is larger than that of an $Nd_2Fe_{14}B$-type composition.

Further, since the amount of substitution of Dy or Tb is 1 atomic percent or more in the Examples 2.15 to 2.19, all of the coercitivities (iHc) are 2000 kA/m or more. In particular, since Cu was added in the Example 2.16, the results were good coercivity (iHc).

As a result, it can be seen that the Examples where the amount of substitution of Dy or Tb is 1 atomic percent or more can be used for an object that needs high heat resistance, such as a motor for a vehicle that is driven under a high-temperature environment. However, excessive substitution may have an adverse effect on the degree of magnetic alignment during hot plastic deforming. Therefore, it is preferable that the amount of substitution is 2.0 atomic percent or less.

Accordingly, in the case that the coercivity is specifically required for use, it is preferable that the amount of substitution of Dy or Tb is 1.0 to 2.0 atomic percent.

Further, comparing the Examples 2.2 to 2.4 that are substantially the same, except for the composition of Cu and Al, it can be seen that the good coercivity (iHc) is obtained in the Examples 2.3 and 2.4 where Cu and Al were added. Similarly, comparing the Examples 2.10 to 2.13 that are substantially the same, except for the composition of Cu and Al, it can be seen that good coercivity (iHc) is obtained in the Examples 2.10, 2.11, and 2.13 where Cu and Al were added.

As a result, it could be seen that the coercivity was increased by adding Cu and Al.

Further, the Examples 2.20 and 2.21 where Nd was substituted for a portion of Pr had equal or more magnetic properties than the Example 2.18 where the total amount of rare-earth elements is substantially the same as those in the above Examples.

It could be seen from the above result that the coercivity was improved by the material for anisotropic magnets relating to the Examples 2.1 to 2.21, without decreasing the remanence. Further, it could be seen that a material for anisotropic magnet according to the present invention could be used for a motor that requires high magnetic force and heat resistance.

Examples 3.1 to 3.9

Comparative Examples 3.1 to 3.15

[1. Manufacturing Specimen]

Pr-based (Examples 3.1 to 3.9 and Comparative examples 3.10 to 3.15) alloy powder and Nd-based (Comparative examples 3.1 to 3.9) alloy powder were produced by the rapid-quenching/solidifying and pulverizing method. The composition of the Pr-based alloy powder was 12.85Pr-5.36B-0.42Ga-bal.Fe (atomic percent). Further, the composition of the Nd-based alloy powder was 12.87Nd-5.38B-0.44Ga-bal.Fe (atomic percent).

By performing cold-pressing, hot-forming, and hot plastic deforming to the alloy powder, a cylindrical formed-body was obtained. The hot-forming was performed by pre-heating the cold-pressed body at 500 to 820° C. under an Ar-atmosphere and then pressing the pre-heated cold-pressed body in a mold heated at 815 to 850° C. But, the pre-heating was not performed to the Comparative examples 3.10 to 3.15. The conditions of the cold-pressing and hot plastic deforming were the same as the Examples 2.1 to 2.21.

The bottom of the obtained cylindrical formed-body was cut off, and then the cylindrical formed-body was magnetized in the radial direction, with the result that a ring-shaped magnet was obtained.

[2. Method of Test]

In accordance with the same order as the Examples 2.1 to 2.21, the magnetic property and the degree of magnetic alignment were measured.

Table 2 shows the result. Table 2 further shows the conditions of pre-heating and hot-forming.

The evaluation of characteristic of the formed-body shown in Table 2 was performed based on below-identified standards.

Taking 15 seconds or less for an extrusion working time is denoted by ◎;

Taking 16 to 20 seconds for an extrusion working time is denoted by ○; and

Taking 21 seconds or more for an extrusion working time is denoted by Δ.

TABLE 2

| | | Pre-Heating | Hot-forming Die | Magnetic Property | | | | Crystal grain | |
|---|---|---|---|---|---|---|---|---|---|
| | Composition | Temperature (° C.) | Temperature (° C.) | Br (T) (T) | iHc (kA/m) | (BH) max (kJ/cm³) | Br/Js | diameter (nm) | Form-ability |
| Example 3.1 | Pr-based | 500 | 850 | 1.26 | 1597.47 | 304.64 | 0.941 | 136 | Δ |
| Example 3.2 | magnet | | | 1.27 | 1588.68 | 304.94 | 0.942 | 124 | |
| Example 3.3 | | | | 1.25 | 1637.88 | 301.19 | 0.936 | 169 | |
| Example 3.4 | | 750 | 815 | 1.32 | 1553.00 | 335.04 | 0.952 | 200 | ◎ |
| Example 3.5 | | | | 1.33 | 1575.73 | 338.71 | 0.955 | 228 | |
| Example 3.6 | | | | 1.36 | 1542.60 | 358.09 | 0.953 | 237 | |
| Example 3.7 | | 820 | 815 | 1.25 | 1359.19 | 297.17 | 0.942 | 705 | |
| Example 3.8 | | | | 1.26 | 1330.48 | 303.93 | 0.938 | 797 | |
| Example 3.9 | | | | 1.26 | 1405.84 | 302.74 | 0.945 | 897 | |
| Comparative Example 3.1 | Nd-based magnet | 500 | 850 | 1.24 | 1489.02 | 292.69 | 0.896 | 154 | Δ |

TABLE 2-continued

| | Composition | Pre-Heating Temperature (° C.) | Hot-forming Die Temperature (° C.) | Magnetic Property Br (T) (T) | iHc (kA/m) | (BH) max (kJ/cm$^3$) | Br/Js | Crystal grain diameter (nm) | Form-ability |
|---|---|---|---|---|---|---|---|---|---|
| Comparative Example 3.2 | | | | 1.23 | 1433.20 | 284.30 | 0.892 | 149 | |
| Comparative Example 3.3 | | | | 1.23 | 1505.66 | 286.48 | 0.894 | 203 | |
| Comparative Example 3.4 | | 750 | 815 | 1.22 | 1428.47 | 282.93 | 0.888 | 247 | ○ |
| Comparative Example 3.5 | | | | 1.24 | 1373.14 | 288.11 | 0.894 | 232 | |
| Comparative Example 3.6 | | | | 1.24 | 1419.05 | 285.85 | 0.897 | 272 | |
| Comparative Example 3.7 | | 820 | 815 | 1.23 | 1373.81 | 284.31 | 0.897 | 760 | |
| Comparative Example 3.8 | | | | 1.24 | 1342.07 | 290.21 | 0.899 | 802 | |
| Comparative Example 3.9 | | | | 1.23 | 1320.44 | 287.15 | 0.896 | 865 | |
| Comparative Example 3.10 | Pr-based magnet | — | 850 | 1.02 | 1500.64 | 244.97 | 0.827 | 926 | Δ |
| Comparative Example 3.11 | | | | 1.18 | 1426.72 | 253.12 | 0.801 | 843 | |
| Comparative Example 3.12 | | | | 1.08 | 1484.16 | 251.46 | 0.833 | 889 | |
| Comparative Example 3.13 | | — | 815 | 1.06 | 1514.32 | 223.64 | 0.810 | 858 | |
| Comparative Example 3.14 | | | | 1.04 | 1502.87 | 227.11 | 0.802 | 796 | |
| Comparative Example 3.15 | | | | 1.01 | 1548.92 | 230.44 | 0.797 | 775 | |

[3. Result]

It can be seen from Table 2 as follows:

(1) In the Pr-based magnet, the maximum energy product $(BH)_{max}$ is at the maximum and the degree of magnetic alignment is over 0.95 at the pre-heating temperature of 750° C. and mold temperature of 815° C., and extremely excellent formability is obtained.

(2) The degree of magnetic alignment of Nd-based magnet is less than 0.90. Its formability is relatively excellent, but it is inferior to Pr-based magnets to which the pre-heating has been performed.

(3) Even in the case of Pr-based magnets, when the pre-heating is not performed, formability of hot-forming deteriorates, thereby the formed-body having a uniform and fine structure is not obtained, thus it takes a lot of time to perform extrusion during hot-plastic deforming. As a result, crystal grains grow, thereby coercivity is decreased and alignment becomes difficult to occur, accordingly remanence is also decreased. In other words, when the pre-heating is performed, the hot working and the hot plastic deforming can be smoothly performed, accordingly the magnetic material having excellent magnetic property can be obtained. Further, the reason that the maximum energy product decreases when the pre-heating temperature is excessively high in case of the Pr-based magnet is considered because of: a decrease of coercivity due to the crystal grains growing and a decrease of remanence due to crystal becoming difficult to align.

(4) On the other hand, a grain boundary phase of Nd-based magnet has such melting point that is higher than that of Pr-based magnet. Therefore, Nd-based magnet needs to be pre-heated at a temperature higher than the case of Pr-based magnet in order to make the hot-formed body having a densified and uniform structure. Namely, in the case of Nd-based magnet, an appropriate pre-heating temperature is shifted to such temperature band as being higher than that of Pr-based magnet. Accordingly, the maximum energy product $(BH)_{max}$ of Nd-based magnet is not affected so much by the pre-heating temperature.

(5) In both of Pr-based magnet and Nd-based magnet, when the pre-heating temperature was less than 500° C., the grain boundary phases did not liquefy, such that cracks frequently occurred in the work after the hot-forming, and it was difficult to form a magnet in many cases.

Figure 8:
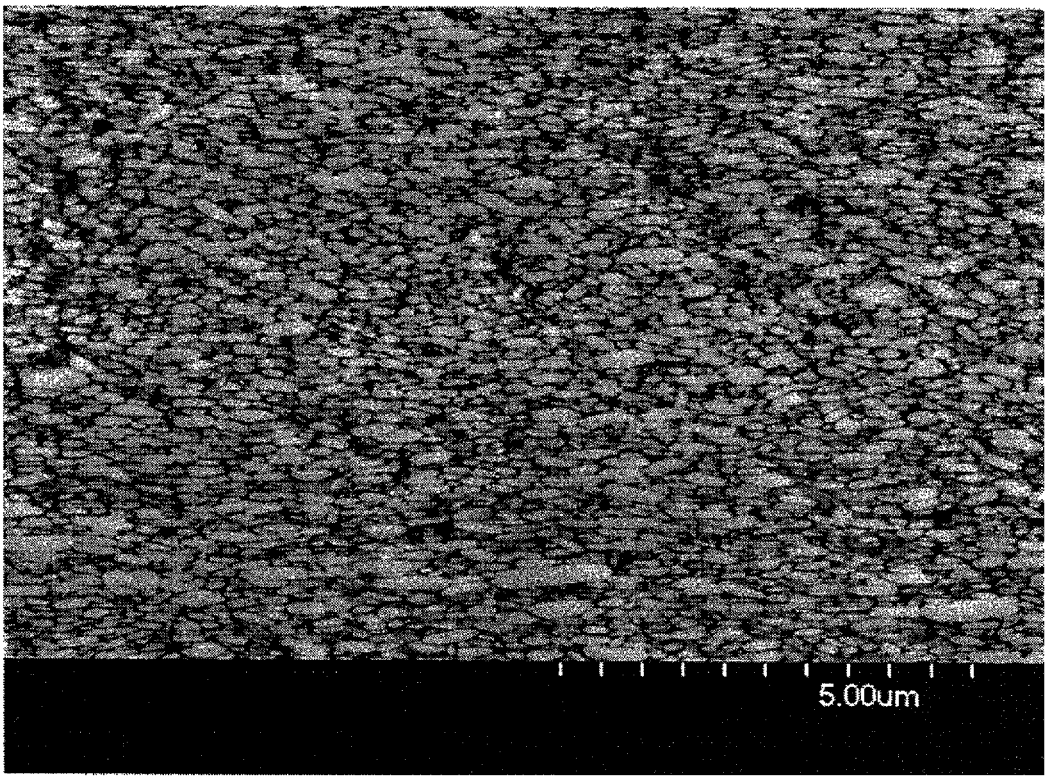
FIG. 8 is a SEM photograph of a Pr-based magnet at 750° C. of pre-heating temperature in hot-pressing.
Figure 9:
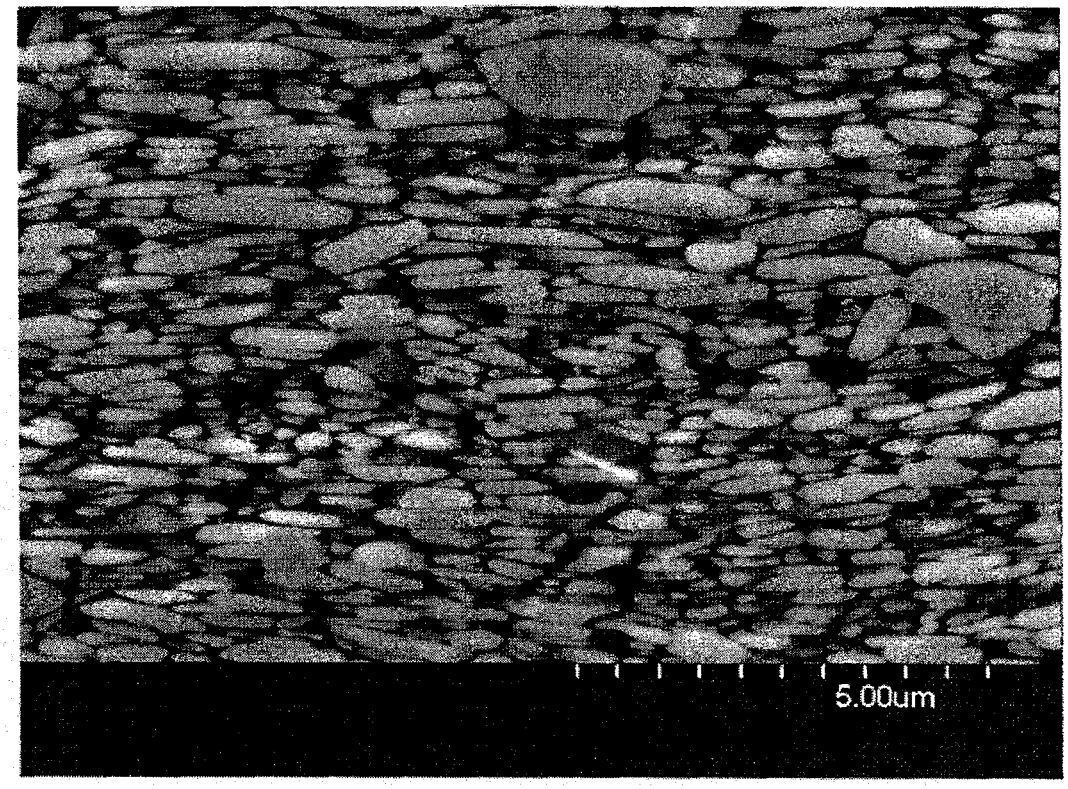
FIG. 9 is a SEM photograph of a Pr-based magnet at 820° C. of pre-heating temperature in hot-pressing.

FIG. 8 and FIG. 9 show SEM photographs of the Pr-based magnet pre-heated at 750° C. and 820° C., respectively. At the pre-heating temperature of 820° C., rough and large particles were contained and the diameter of the crystal grain was 700 nm or more. On the other hand, at the pre-heating temperature of 750° C., rough and large particles were not contained and the diameter of the crystal grain was approximately 200 nm. It is considered that a high magnetic property is obtained because the crystal grains become uniform and fine by performing the pre-heating at a temperature of 750° C.

From the above result, it could be seen that, the Pr-based magnet of which the melting point of grain boundary phase was lower than that of the Nd-based magnet had appropriate pre-heating temperature at which the magnet could be formed and reduction of magnetic property was small.

A material for anisotropic magnet according to the present invention is designed to improve coercivity without decreasing remanence. Therefore, the present invention can be appropriately used particularly for motors for vehicles that require high coercivity and remanence. The reason is as follows: since these motors are driven under a high-temperature environment, the material for anisotropic magnet requires heat resistance and, further, miniaturization of the parts of the vehicles requires high rotational force (magnetic force).

What is claimed is:

1. A hot plastically deformed anisotropic magnet having aligned axes of easy magnetization of crystal grains of the magnet, the anisotropic magnet comprising:

(1) a T-based composition consisting of R, B, Ga, and a balance of T and inevitable impurities, wherein R is Pr or Pr that is optionally substituted with at least one element selected from the group consisting of Nd, Dy, and Tb;

wherein an amount of R is 12.5 to 15 atomic percent;

an amount of B is 4.5 to 6.5 atomic percent; and an amount of Ga is 0.1 to 0.7 atomic percent;

wherein T is Fe or Fe partially substituted with Co, and having (2) a degree of magnetic alignment of 0.92 or more, wherein the degree of magnetization is defined by remanence (Br) / saturation magnetization (Js), wherein the remanence (Br) is 1.20 T or more, and a coercivity is 1600 kA/m or more; and (3) flattened crystal grains having a crystal grain diameter of 1 μm or less, and wherein R contains at least 50 atomic percent of Pr.

2. A hot plastically deformed anisotropic magnet having aligned axes of easy magnetization of crystal grains of the magnet, the anisotropic magnet comprising (1) a T-based composition consisting of R, B, Ga, at least one element selected from the group consisting of Cu and Al, and a balance of T and inevitable impurities, wherein R is Pr or Pr that is optionally substituted with at least one element selected from the group consisting of Nd, Dy, and Tb;

wherein an amount of R is 12.5 to 15 atomic percent;

an amount of B is 4.5 to 6.5 atomic percent; and an amount of Ga is 0.1 to 0.7 atomic percent;

wherein T is Fe or Fe partially substituted with Co, and having (2) a degree of magnetic alignment of 0.92 or more, wherein the degree of magnetization is defined by remanence (Br) / saturation magnetization (Js), wherein the remanence is 1.20 T or more, and a coercivity is 1600 kA/m or more; and (3) flattened crystal grains having a crystal grain diameter of 1 μm or less, and wherein R contains at least 50 atomic percent of Pr.

3. A method of manufacturing a magnet comprising:

dissolving an alloy to form a molten alloy;

rapidly-quenching the molten alloy forming a ribbon;

pulverizing the ribbon to form an alloy powder;

cold-pressing the alloy powder to form a cold-pressed body;

pre-heating the cold-pressed body under a temperature of 500° C. to 850° C. to obtain a pre-heated cold-pressed body;

hot-forming the pre-heated cold-pressed body to obtain a hot-formed body; and performing a hot plastic deforming to the hot-formed body to form an anisotropic magnet according to claim 1.

4. A method of manufacturing a magnet comprising:

dissolving an alloy to form a molten alloy;

rapidly-quenching the molten alloy forming a ribbon;

pulverizing the ribbon to form an alloy powder;

cold-pressing the alloy powder to form a cold-pressed body;

pre-heating the cold-pressed body under a temperature of 500° C. to 850° C. to obtain a pre-heated cold-pressed body;

hot-forming the pre-heated cold-pressed body to obtain a hot-formed body; and performing a hot plastic deforming to the hot-formed body to form an anisotropic magnet according to claim 2.

5. The hot plastically deformed anisotropic magnet according to claim 1, wherein R is Pr.

6. The hot plastically deformed anisotropic magnet according to claim 1, wherein an axis of easy magnetization of a $R_2Fe_{14}B$ crystal is aligned.

7. The hot plastically deformed anisotropic magnet according to claim 1, wherein the alloy powder is in a flake form composed of fine crystal grains.

8. The hot plastically deformed anisotropic magnet according to claim 2, wherein R is Pr.

9. The hot plastically deformed anisotropic magnet according to claim 2, wherein an axis of easy magnetization of a $R_2Fe_{14}B$ crystal is aligned.

10. The hot plastically deformed anisotropic magnet according to claim 2, wherein the alloy powder is in a flake form composed of fine crystal grains.

* * * * *